United States Patent [19]

Pfaff

[11] Patent Number: 5,019,709

[45] Date of Patent: May 28, 1991

[54] ELECTRODE ARRANGEMENT FOR CHEATING CORONA

[76] Inventor: Ernest H. Pfaff, 1549 Woodvale Ave., Deerfield, Ill. 60015

[21] Appl. No.: 461,334

[22] Filed: Jan. 5, 1990

[51] Int. Cl.[5] ..... H01T 19/04

[52] U.S. Cl. ..... 250/324; 313/243

[58] Field of Search ..... 250/324, 325, 326; 313/243; 361/225, 231, 232

[56] References Cited

U.S. PATENT DOCUMENTS

| | | | |
|---|---|---|---|
| 1,531,196 | 3/1925 | Kuhlenschmidt | 250/324 |
| 3,787,722 | 1/1974 | Hatsell | 361/225 |
| 3,908,191 | 9/1975 | Forgo et al. | 346/155 |
| 4,324,999 | 4/1982 | Wolfe | 313/336 |
| 4,578,614 | 3/1986 | Gray | 11/250 |
| 4,693,869 | 9/1987 | Pfaff | 313/243 |

*Primary Examiner*—Bruce C. Anderson

*Attorney, Agent, or Firm*—Lee, Main, Smith, McWilliams & Sweeney

[57] ABSTRACT

An electrode arrangement for creation of a corona over an area. The arrangement includes a corona driving portion and a corona emitting portion in electrical contact with the corona driving portion. The corona driving portion is much larger in size than the corona emitting portion such that corona from the electrode arrangement is emitted from the corona emitting portion in a direction away from the corona driving portion. The corona emitting portion is comprised of a series of stepped, generally concentric, spaced corona emitting rings about a center emitting element. The locations of the rings and emitting element are such that a corona is produced over a circular area rather than an annular ring.

8 Claims, 1 Drawing Sheet

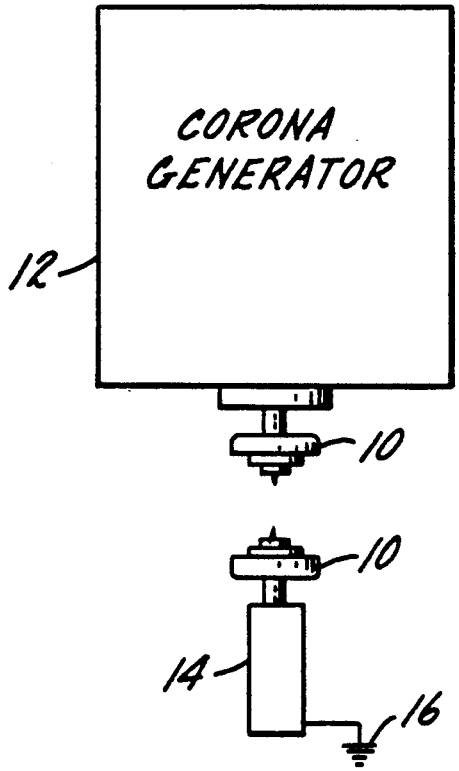
Fig. 1.
Fig. 2.
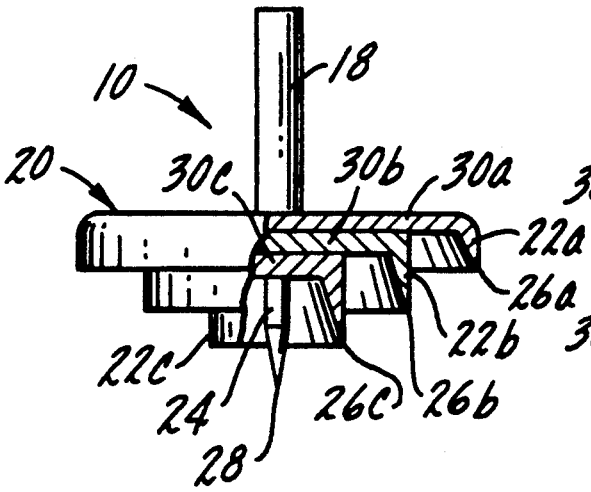
Fig. 3.
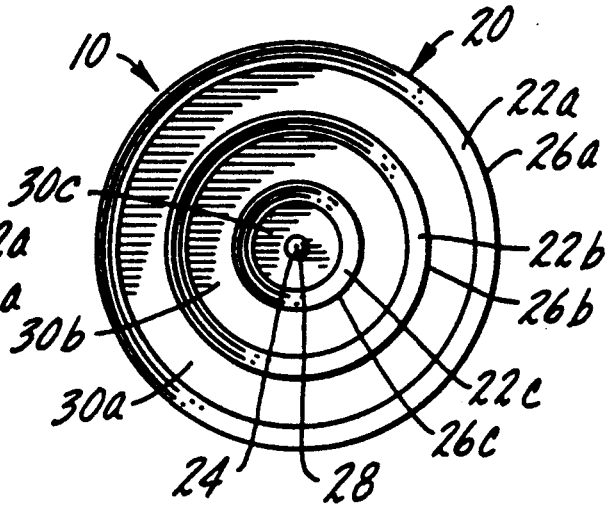

ELECTRODE ARRANGEMENT FOR CHEATING CORONA

BACKGROUND OF THE INVENTION

This invention relates to creation of electrical coronas, and in particular to an electrode arrangement for creation of a corona for surface treating desired areas of plastics and other materials.

As explained in U.S. Pat. No. 4,693,869, the disclosure of which is incorporated herein by reference, many plastics, when molded, will not accept an adhesive, a coating, or inks or other printing vehicles unless the surface of the plastic has been chemically and/or physically altered. The referenced patent discloses an electrode arrangement for creating a corona for treating such surfaces to accept adhesives, coatings, inks or other materials applied to the surface. One form of that patent pertains to a disc-like electrode which is able to create a corona in an annular fashion only because a corona will not be emitted at any location other than the outer periphery of the electrode, thus leaving a circular central area without a treating corona.

U.S. patent application Ser. No. 318,535, filed Mar. 3, 1989, now U.S. Pat. No. 4,924,092, issued May 8, 1990 the disclosure of which is also incorporated herein by reference, is directed to a unique a system for creating a uniform corona over a predetermined volume of free space, so that a plastic or other material can be treated on all sides at one time, rather on only a single side. In both the referenced patent and the referenced application, a high frequency electrical corona generator is used to generate resonant frequencies on the order of 2MHz and above.

SUMMARY OF THE INVENTION

The present invention provides an improved electrode arrangement for creation of a corona. The electrode arrangement is configured to be attached to an appropriate electrical corona generator and is made of an electrically conductive material, such as metal. The electrode arrangement is formed for creation of a corona over an area to be treated, and includes a stem for attachment to the corona generator, a corona driving portion secured to the stem, and a corona emitting portion in electrical contact with the corona driving portion. The corona driving portion is greater in size than the corona emitting portion such that the corona emitted from the electrode arrangement is emitted essentially from the corona emitting portion in a direction away from the corona driving portion. To cover an entire area being treated, the corona emitting portion comprises a plurality of stepped, generally concentric, spaced emitting elements.

In accordance with the preferred form of the invention, the corona emitting elements are stepped from an outer emitting element to a central emitting element. The emitting elements are stepped essentially linearly; that is, a line drawn from the edge of the outermost emitting element to the edge of the innermost emitting element would engage the edges of all emitting elements in between.

In the illustrated embodiment of the invention, the emitting elements comprise concentric rings about a central emitting element. The rings are circular, and each ring includes a taper to a corona emitting edge. The center emitting element includes a taper to a corona emitting point at the axial center of the electrode arrangement.

Not only are the corona emitting elements stepped essentially linearly, but also spacing between adjacent emitting is essentially equal, so that the intensity of the corona emitted is generally uniform across the area of any material being treated.

BRIEF DESCRIPTION OF THE DRAWING

The invention is described in greater detail in the following description of an example embodying the best mode of the invention, taken in conjunction with the drawing figures, in which:

FIG. 1 is a schematic illustration of the electrode arrangement according to the invention in conjunction with a corona generator and a resonator coil, FIG. 2 is an elevational illustration of the invention, partially in cross section to show the internal structure, and FIG. 3 is a bottom plan view of the electrode arrangement shown in FIG. 2.

DESCRIPTION OF AN EXAMPLE EMBODYING THE BEST MODE OF THE INVENTION

Illustrated in all drawing figures is an electrode 10 according to the invention. The electrode 10 is shown installed in FIG. 1 within a corona generator 12 with a second electrode 10 installed within a resonator coil 18. The corona generator 12 can be any readily available high voltage, high frequency corona generator, such as the BD-80 surface treater manufactured by Electro-Technic Products "Inc.", Chicago, Ill. The BD-80 surface treater will optimally operate at 250kv at a frequency of 2MHz. Other suitable corona generators can be employed, and the invention is not limited to any particular type of corona generator nor any specific value of voltage or frequency generated by the corona generator, so long as a corona can be generated from the electrode 10. Also, the resonator coil 14 is preferably as described in referenced U.S. Pat. No. 4,924,092, the coil being composed of 225 turns of number 30 magnetic wire which are wound at a rate of 30 turns per lineal inch. The resonator coil 14 is connected to a ground 16, preferably being the same ground as that for the corona generator 12.

As shown in FIG. 2 and 3, the electrode 10 is composed of a stem 18 attached to a disk-like corona driving element 20. A series of ring-like corona emitting elements 22 extend from the corona driving element 20, a first corona emitting element **22*a* being formed at the outer circumference of the driving element 20, a second corona emitting element 22*b* spaced inwardly therefrom and a third corona emitting element 22*c* being spaced further inwardly therefrom. A center emitting element 24 is located at the precise center of the corona driving element 20, as best shown in FIG. 3**.

Each of the corona emitting elements 22 is in the form of a ring, and tapers to a tip or edge **26*a*–*c* from which corona is emitted. Similarly, the center emitting element 24 tapers to a point 28** from which the corona is emitted.

The emitting elements 22 and 24 are stepped from the outer emitting element **22*a* to the center emitting element 24. They are stepped essentially linearly. That is to say, if a line were drawn from the tip 26*a* to the point 28, the tips 26*b* and 26*c* would lie along that line. Also, spacing between the adjacent emitting elements 22, and between the emitting element 22*c* and the center emitting element 24, is essentially equal. With the linear stepping of the elements and equal spacing, the corona emitted from the electrode 10** is generally uniform, and therefore a surface to be treated is treated uniformly.

As explained in referenced U.S. Pat. No, 4,693,869, were only the outer emitting element 22*a* employed, the corona would be emitted downwardly in a direction away from the corona driving element 20 in a ring-like fashion due to the annular nature of the emitting element 22*a*. Also, because the corona consists of ionized gas, the corona would extend outwardly from the tip 26 and not toward the center of the area beneath the electrode 10. This would also be the case were other corona emitting tips or points located inwardly of the emitting element 22*a*, but not extending below the tip 26*a*. However, with the stepped emitting element arrangement illustrated in the drawings, corona is emitted downwardly and outwardly from each of the tips 26 and the point 28. A generally uniform corona is therefore created. Because of the uniform corona, an area of a stationary object can be treated without moving the object, as required in the past. Also, the uniform corona permits three-dimensional treating.

The corona driving element 20 may be a unitary portion of the electrode 10 or, as best shown in FIG. 2, may be composed of disc-like portions 30*a*, 30*b* and 30*c* from which the corona emitting elements 22*a*–22*c* respectively extend. As illustrated, in this configuration, the disc portions 30*a*–30*c* and corresponding repective emitting elements 22*a*–22*c* are unitary. The electrode 10 can be assembled by forming a threaded post extending from the emitting element 24, protruding through appropriate apertures in the disc portions 30*a*–30 *c*, and engaging an internally threaded bore in the stem 18. Alternatively, the electrode 10 can be assembled in any well-known, conventional manner. The particular means of formation of the electrode 10 forms no part of the claimed invention.

When the resonator coil 14 as illustrated in FIG. 1 is utilized, an enveloping volume of corona is created between the two electrodes 10, permitting three-dimensional treating of all sides of an article passed through the created corona (not illustrated). As explained in referenced U.S. Pat. No. 4,924,092, when the corona generator 12 is activated, corona is emitted from the first electrode 10 attached to the corona generator 12. The electrical field created by the first electrode 10 induces a high voltage in the resonator coil 14, and the coil 14 then activates the second electrode 10 attached therewithin to emit a corona in the direction of the first electrode 10. The emitted corona fills the volume between the electrodes 10, and therefore any item passed between the electrodes 10 will be treated on all sides and in three dimensions, so long as the entire object to be treated is enveloped by the corona between the electrodes.

Various changes can be made to the invention without departing from the spirit thereof or scope of the following claims.

What is claimed is:

1. An electrode arrangement for creation of a corona over an area, the electrode being configured for attachment to a high frequency generator and being made of an electrically conductive material, the electrode arrangement comprising a. a stem for attachment to the cororna generator, b. a corona driving portion secured to said stem, c. a corona emitting portion in electrical contact with said corona driving portion, d. said corona driving portion being greater in size than said corona emitting portion such that corona from the electrode arrangement is emitted essentially from said corona emitting portion in a direction away from said corona driving portion, and e. said corona emitting portion comprising a plurality of generally concentric emitting elements separated by spaces, said emitting elements being stepped at an increasingly greater distance from said corona driving portion from an outer emitting element to an inner emitting element, and said spaces being incapable of emitting corona.

2. An electrode arrangement according to claim 1 in which said emitting elements are stepped from said outer emitting element to a central emitting element.

3. An electrode arrangement according to claim 2 in which said emitting elements are stepped essentially linearly.

4. An electrode arrangement according to claim 1 in which said emitting elements comprise concentric rings and a center emitting element.

5. An electrode arrangement according to claim 4 in which said rings are circular.

6. An electrode arrangement according to claim 4 in which each ring includes a taper to a corona emitting edge.

7. An electrode arrangement according to claim 4 in which said center emitting element includes a taper to a corona emitting point.

8. An electrode arrangement according to claim 1 in which spacing. between adjacent emitting elements is essentially equal.

* * * * *

UNITED STATES PATENT AND TRADEMARK OFFICE

CERTIFICATE OF CORRECTION

PATENT NO. : 5,019,709

DATED : May 28, 1991

INVENTOR(S) : Ernest H. Pfaff

It is certified that error appears in the above-identified patent and that said Letters Patent is hereby corrected as shown below:

ON TITLE PAGE: Item [54] and in column 1.

The title should read: Electrode Arrangement For Creating Corona

Signed and Sealed this

Twenty-ninth Day of September, 1992

*Attest:*

DOUGLAS B. COMER

*Attesting Officer*

*Acting Commissioner of Patents and Trademarks*